US011628548B2

(12) United States Patent
Bauer

(10) Patent No.: US 11,628,548 B2
(45) Date of Patent: Apr. 18, 2023

(54) COMPRESSED AIR NAILER WITH SAFETY ACTUATOR

(71) Applicant: Joh. Friedrich Behrens AG, Ahrensburg (DE)

(72) Inventor: Joachim Bauer, Bad Oldesloe (DE)

(73) Assignee: Joh. Friedrich Behrens AG, Ahrensburg (DE)

( * ) Notice: Subject to any disclaimer, the term of this patent is extended or adjusted under 35 U.S.C. 154(b) by 145 days.

(21) Appl. No.: 16/756,594

(22) PCT Filed: Sep. 27, 2018

(86) PCT No.: PCT/EP2018/076327

§ 371 (c)(1),
(2) Date: Apr. 16, 2020

(87) PCT Pub. No.: WO2019/076605

PCT Pub. Date: Apr. 25, 2019

(65) Prior Publication Data

US 2020/0238492 A1 Jul. 30, 2020

(30) Foreign Application Priority Data

Oct. 18, 2017 (EP) ..... 17197102

(51) Int. Cl.
*B25C 1/00* (2006.01)
*B25C 1/04* (2006.01)

(52) U.S. Cl.
CPC ..... *B25C 1/008* (2013.01); *B25C 1/043* (2013.01)

(58) Field of Classification Search
CPC .. B25C 1/04; B25C 1/06; B25C 1/008; B25C 1/043; B25C 1/047
See application file for complete search history.

(56) References Cited

U.S. PATENT DOCUMENTS 3,477,629 A 11/1969 Becht
5,370,037 A * 12/1994 Bauer ..... B25C 1/042 91/274

(Continued)

FOREIGN PATENT DOCUMENTS

DE 1603979 12/1970
DE 2516157 A1 10/1976

(Continued)

OTHER PUBLICATIONS

TW M487812; filed May 30, 2014; Taiwan Office Action; dated Oct. 12, 2021 (4 pages).

(Continued)

*Primary Examiner* — Anna K Kinsaul
*Assistant Examiner* — Veronica Martin
(74) *Attorney, Agent, or Firm* — Barclay Damon LLP

(57) ABSTRACT

A compressed air nailer comprises a driving tappet connected to a compressed air supply and configured to drive in a fastener. A triggering apparatus is configured to trigger a driving process and a working piston is coupled to a driving tappet. A safety actuator is configured to be displaced between a locked position and an open position, wherein when in the locked position, the safety actuator is configured to inhibit the triggering of the driving process when an actuation of the triggering apparatus occurs. The compressed air nailer further comprises a throttle and a safety control chamber configured to be aerated and deaerated by the throttle. A counterforce generator is configured to generate a counterforce that acts on the safety actuator and is directed in an opposite direction from the actuating force. The counterforce is linearly dependent on an operating pressure of the compressed air nailer.

13 Claims, 6 Drawing Sheets

(56) References Cited

U.S. PATENT DOCUMENTS

| | | | | |
|---|---|---|---|---|
| 2014/0231485 | A1* | 8/2014 | Bauer | B25C 1/008 227/8 |
| 2017/0266795 | A1* | 9/2017 | Lai | B25C 1/042 |

FOREIGN PATENT DOCUMENTS

| | | | |
|---|---|---|---|
| EP | 2767365 | | 8/2014 |
| EP | 2767365 | A1 | 8/2014 |
| RU | 2039644 | C1 | 10/1976 |
| RU | 2518826 | C2 | 6/2014 |
| SU | 418316 | A1 | 3/1974 |
| SU | 537809 | A1 | 12/1976 |
| SU | 895647 | A1 | 1/1982 |
| TW | M487812 | U | 10/2014 |

OTHER PUBLICATIONS

PCT/EP2018/076327; English Translation of International Search Report; dated Nov. 2, 2018 (3 pages).
RU 2020113424/05(022648); filed Sep. 27, 2018; Russian Office Action; dated Dec. 27, 2021 (6 pages).
RU 2020113424/05(022648); filed Sep. 27, 2018; English Translation of Russian Office Action; dated Dec. 27, 2021 (6 pages).
RU 2020113424/05(022648); filed Sep. 27, 2018; Search Report; dated Dec. 27, 2021 (3 pages).
JP 2020-518756; filed Sep. 27, 2018; Japanese Office Action; dated Jul. 29, 2022 (7 pages).
CN 201880067722.5; filed Sep. 27, 2018; Chinese Office Action; dated Aug. 11, 2022 (13 pages).
RU 2020113424/05(022648); filed Sep. 27, 2018; Russian Office Action; dated Nov. 23, 2022 (4 pages).
RU 2020113424/05(022648); filed Sep. 27, 2018; English translation Russian Office Action; dated Nov. 23, 2022 (4 pages).

* cited by examiner

COMPRESSED AIR NAILER WITH SAFETY ACTUATOR

CROSS REFERENCE TO RELATED INVENTION

This application is a national stage application pursuant to 35 U.S.C. § 371 of International Application No. PCT/EP2018/076327, filed on Sep. 27, 2018, which claims priority to, and benefit of, European Patent Application No. 17197102.1, filed Oct. 18, 2017, the entire contents of which are hereby incorporated by reference.

BACKGROUND

The invention relates to a compressed air nailer with a triggering apparatus, a safety actuator that can be displaced between a locked position and an open position and that, when in the locked position, is configured to prevent the triggering of a driving process, a safety control chamber that is aerated or deaerated by a throttle, wherein the pressure in the safety control chamber exerts an actuating force on the safety actuator, and a counterforce generator that generates a counterforce that acts on the safety actuator and is directed in the opposite direction from the actuating force.

Known compressed air nailers of this type can be used in two different operating modes. With so-called single triggering, the compressed air nailer is first placed onto a workpiece which actuates a placing sensor. Subsequently, a trigger is actuated manually and, as a result, an individual driving process is triggered.

With so-called contact triggering, also denoted as "touching", the user already holds the trigger pressed down while the compressed air nailer contacts the workpiece. When the workpiece is touched, the placing sensor is actuated and, as a result, a driving process is triggered. The compressed air nailer may be placed repeatedly in rapid succession which permits a very rapid operation, in particular when a plurality of fastening means must be driven in for sufficient fastening, and the set requirements for the positional accuracy thereof are only minimal.

In specific situations, however, an increased risk of injury arises from the contact triggering method. If, for example, the user holds the actuated trigger pressed down not only when he wishes to position the compressed air nailer onto one and the same workpiece at a spacing of a few centimeters from the previously driven-in fastening means, but also when he changes to a different workpiece arranged at a distance therefrom, a driving process may be triggered by the placing sensor unintentionally touching an object or body part. For example, it may lead to accidents when a user (by ignoring important safety rules) climbs on a ladder with the compressed air nailer, holds the trigger pressed down and unintentionally touches the placing sensor with his leg.

A compressed air nailer with a control valve apparatus and a pressure-controlled control valve for automatic operation is known from document DE 1 603 979 B1. The pressure-controlled control valve has an oscillating piston that swings back-and-forth when the trigger is continuously actuated which causes an ongoing driving of fastening means. There is no safety mechanism that interferes in this process so that the driving process is not triggered despite correctly actuating the trigger.

A compressed air nailer of the aforementioned type was disclosed in publication EP 2 767 365 A1. In the known unit, the safety actuator is a locking piston which, when in the locked position, prevents the triggering of a driving process, in particular prevents it by interfering in a stroke of a pilot valve piston. The means for generating a counterforce consist of a spring that presses the locking piston into an open position. The safety control chamber is slowly aerated by the throttle upon actuating a control valve coupled to the trigger. If the pressure in the safety control chamber exceeds a given pressure threshold, the locking piston is displaced against the force of the spring into the locked position such that an (additional) triggering is impossible. With the known unit, this time control serves to limit a time period in which a contact triggering can occur after a previous triggering. After expiration of the time period, the compressed air nailer is locked until the trigger is released, the pressure in the safety control chamber again reaches its initial state, and the locking piston returns to the open position.

The document DE 10 2013 106 657 A1 also discloses a compressed air nailer of the aforementioned type. In an exemplary embodiment, the safety actuator is a small piston that changes the position of a rocker integrated into a triggering apparatus. In another exemplary embodiment, the safety actuator is a sleeve arranged around a valve pin. In both cases, the safety actuator is displaced by a pressure in a safety control chamber against the force of a spring.

Against this background, it is the object of the invention to provide a compressed air nailer with an improved safety mechanism.

BRIEF SUMMARY OF THE INVENTION

In an embodiment, a compressed air nailer comprises a working piston which is connected to a driving tappet for driving in a fastening means and to which compressed air is applied when a driving process is triggered. A triggering apparatus is further provided for triggering a driving process. A safety actuator that can be displaced between a locked position and an open position and that, when in the locked position, is configured to prevent the triggering of a driving process. The compressed air nailer further comprises a safety control chamber, which is aerated or deaerated by a throttle, wherein the pressure in the safety control chamber exerts an actuating force on the safety actuator. A counterforce is generated and acts on the safety actuator. The counterforce is directed in the opposite direction from the actuating force. The counterforce is linearly dependent on an operating pressure of the compressed air nailer.

The compressed air nailer is used for driving in fastening means, such as nails, tacks or staples. To this end, the compressed air nailer may have a magazine for the fastening means, in each case a fastening means being supplied therefrom to a seat of an outlet tool of the compressed air nailer.

Both the driving as well as the controlling of the compressed air nailer can be entirely pneumatic; a supply with electrical energy is therefore unnecessary. "Deaerating" means that a connection is established to a depressurized space, in particular to external air. "Aerating" means that a connection is established to a space that conducts compressed air.

When triggering a driving process, a working piston of the compressed air nailer is subjected to compressed air. In this case, the working piston drives a driving tappet which is connected to the working piston. The driving tappet strikes a rear end of the fastening means in the seat of the outlet tool and drives the fastening means into the workpiece.

The triggering apparatus has a manually actuatable trigger, such as in the form of a toggle switch or sliding switch. It can moreover have a placing sensor. The placing sensor is in particular a mechanical component which protrudes over the front end of an outlet tool and is retained in this position by a spring until the compressed air nailer is placed onto a workpiece. Then the placing sensor is displaced opposite the direction of the spring force and opposite the driving direction. In order to trigger a driving process, at least one control valve is actuated with the triggering apparatus. Depending on the embodiment, common actuation of the trigger and placing sensor may be necessary, possibly also in a specific sequence.

The safety actuator can be displaced between an open position and a closed position. In the open position, the triggering of a driving process is possible by correctly actuating the triggering apparatus. If the triggering apparatus for example comprises a manually actuated trigger and a placing sensor, the joint actuation of which leads to the actuation of a control valve which applies pressure to the working piston, possibly with the inclusion of other valves, this process occurs when the triggering apparatus is correctly actuated. In this case, the safety actuator can always be located in its open position. In this respect, it does not actively participate in the triggering and driving process.

If the safety actuator is contrastingly located in its locked position, it prevents the triggering of a driving process. For this purpose, the safety actuator interferes in the triggering and driving process such that a correct actuation of the triggering apparatus does not trigger a driving process. This can be done in different ways. For example, the safety actuator can interrupt a mechanical chain of action between the triggering apparatus and a control valve controlled by the triggering apparatus, for example in that mechanical engagement between a placing sensor and an actuating element that acts on the control valve is released.

Alternatively, the safety actuator can exert a valve function. For this purpose, it can for example block a line when in the locked position that must to be aerated or deaerated to trigger a driving process. In the open position of the safety actuator, this line can be open or respectively be connected to a safety valve arrangement. In another embodiment, the safety actuator can exert a locking function, for example by blocking a pressure-actuated valve actuator or limiting its adjustment path.

The position in which the safety actuator is located largely depends on the ratio of the actuating force to the counterforce, wherein the level of the actuating force depends on the pressure in the safety control chamber. It changes over time by means of air flowing through the throttle into the safety control chamber or escaping out of the safety control chamber. The inventors have recognized that the time characteristic of this pressure change in the safety control chamber depends on the current operating pressure and that, in conjunction with a counterforce exerted by a spring that does not depend on the operating pressure, causes fluctuations of the duration that passes until the safety actuator is displaced into the locked position. Consequently, this can for example enable sequential contact triggerings at an interval of 5 seconds at a relatively low operating pressure, because the safety actuator only enters the locked position after 5.1 seconds. In certain circumstances, this constitutes a safety risk. At a relatively high operating pressure, sequential contact triggerings may be impossible at an interval of 1.5 seconds, however, because the safety actuator already enters its locked position after 1.4 seconds. In this instance, it may be impossible to efficiently work in contact triggering mode in certain circumstances.

The invention provides assistance in this case in that the means for generating the counterforce are designed such that the level of the counterforce is linearly dependent on an operating pressure of the compressed air nailer. The actuating force and counterforce are thereby equally affected by fluctuations in the operating pressure. The threshold of the pressure in the safety control chamber which must be exceeded to overcome the counterforce also depends on the operating pressure. Consequently, the duration until the pressure threshold is exceeded remains largely independent of the operating pressure. The compressed air nailer thereby always reacts in the usual way, even given significant fluctuations in the operating pressure. In particular, the time period in which a further triggering is possible after a triggering remains largely constant.

In one embodiment, the level of the counterforce lies within a range of 10% to 90% of the actuating force when the operating pressure prevails in the safety control chamber. Preferably, the level of the counterforce lies within a range of 30% to 70% of the actuating force when the operating pressure prevails in the safety control chamber. The counterforce which is linearly dependent on the operating pressure thus achieves a level that corresponds to the actuating force given an average pressure in the safety control chamber. Any additional forces that act on the safety actuator and are not linearly dependent on the operating pressure such as weight or elastic force therefore do not significantly influence the position of the safety actuator during operation and the duration until a displacement of the safety actuator.

In one embodiment, the counterforce generator comprises a control space, wherein the pressure in the control space acts on the safety actuator. Independent of how the pressure in the control space is generated in particular, its level fluctuates with the operating pressure. The solution is therefore particularly simple for generating a counterforce that is linearly dependent on the operating pressure.

In one embodiment, the pressure in the safety control chamber acts on a first effective surface of the safety actuator, and the pressure in the control space acts on a second effective surface of the safety actuator, wherein the second effective surface is smaller than the first effective surface. This design measure ensures that the actuating force and counterforce are in an appropriate ratio.

In one embodiment, the size of the second effective surface lies within a range of 10% to 90% of the size of the first effective surface. In particular, the size of the second effective surface can lie within a range of 30% to 90% of the size of the first effective surface. Consequently, even when additional forces that do not depend on the operating pressure act on the safety actuator, the position of the safety actuator is largely determined by the pressures in the safety control chamber and in the control space.

In one embodiment, the operating pressure always prevails in the control space when the compressed air nailer is connected to a compressed air supply. In principle, the compressed air nailer can have a compressed air connection by means of which it is supplied with a certain operating pressure. If a continuous connection exists between the compressed air connection and the control space, the operating pressure always prevails in the control space. The counterforce is then only dependent on the operating pressure, and not on an operating state of the compressed air nailer.

In one embodiment, a spring exists that exerts an additional force on the safety actuator. The additional force can act in the direction of the actuating force, or in the direction of the counterforce. Since it is exerted by a spring, it is independent of the operating pressure. It can therefore preferably be chosen to be relatively small, for example less than 10% of the actuating force which is exerted by the pressure in the safety control chamber when the operating pressure prevails in the safety control chamber. The advantage of the spring is that the safety actuator is displaced into a preferred position when the compressed air nailer is not connected to a compressed air supply. This ensures a specific initial state when starting up the compressed air nailer. If the preferred position is the locked position, the safety actuator is moved at least once in each use of the compressed air nailer, which counteracts the safety element from jamming.

In one embodiment, the triggering apparatus has a trigger and a placing sensor which, when actuated jointly, control a first control valve and can trigger a driving process, wherein the safety actuator is designed to release a mechanical engagement between the triggering apparatus and the control valve when in the locked position. In particular, the trigger and placing sensor are coupled by a mechanical actuating element such as a rocker, and the safety actuator, when in the locked position, can release an engagement between the placing sensor and the mechanical actuating element, and can establish/permit an engagement in the open position.

In one embodiment, the compressed air nailer has a first control line, the aeration or deaeration of which triggers a driving process, wherein the safety actuator, when in the locked position, is designed to block a connecting line between the first control line and the triggering apparatus. In the open position, the connecting line can be open. In this case, the safety actuator thus exerts a valve function.

In one embodiment, the triggering apparatus has a trigger and a placing sensor which, when jointly actuated, control a first control valve and trigger a driving process if the pressure in the safety control chamber lies above a pressure threshold, and has a second control valve that is controlled independent of actuating the placing sensor when the trigger is actuated, wherein the safety control chamber is continuously aerated via the throttle independent of the position of the second control valve and is separated from a housing interior that is under pressure when the second control valve is controlled. When the trigger is actuated, the second control valve is controlled independent of an actuation of the placing sensor, i.e., upon each actuation of the trigger. For this purpose, for example a control pin of the second control valve can be arranged such that it is displaced from its home position upon each actuation of the trigger. An advantage of this embodiment is that when the compressed air nailer is in its basic state, a slight air stream escapes via the throttle when the trigger is not actuated. This is acoustically perceptible and indicates to a user that the compressed air nailer is ready to operate and contact triggering can occur if desired. When the trigger is actuated, the safety control chamber is no longer aerated, and the operating noise quickly becomes softer until it stops. This indicates to the user that the trigger must first be released for an additional triggering.

In one embodiment, an opening cross-section of the throttle is dimensioned such that the actuating force falls below the counterforce after the expiration of a period within a range of 1 second to 10 seconds after the second control valve is controlled. At this moment, the safety actuator is displaced into the locked position. In particular, the cited period can lie within a range of 2 seconds to 6 seconds, preferably about 4 seconds.

In one embodiment, there is a non-return valve by means of which the safety control chamber is aerated when a driving process is triggered. Independent of the actuation of the triggering apparatus, this measure causes a resetting of the pressure in the safety control chamber. The period in which an additional triggering is possible starts to run again.

BRIEF DESCRIPTION OF THE DRAWINGS

The invention is explained in greater detail below with reference to an exemplary embodiment shown in figures. In the figures.

DETAILED DESCRIPTION OF THE INVENTION

Figure 1:
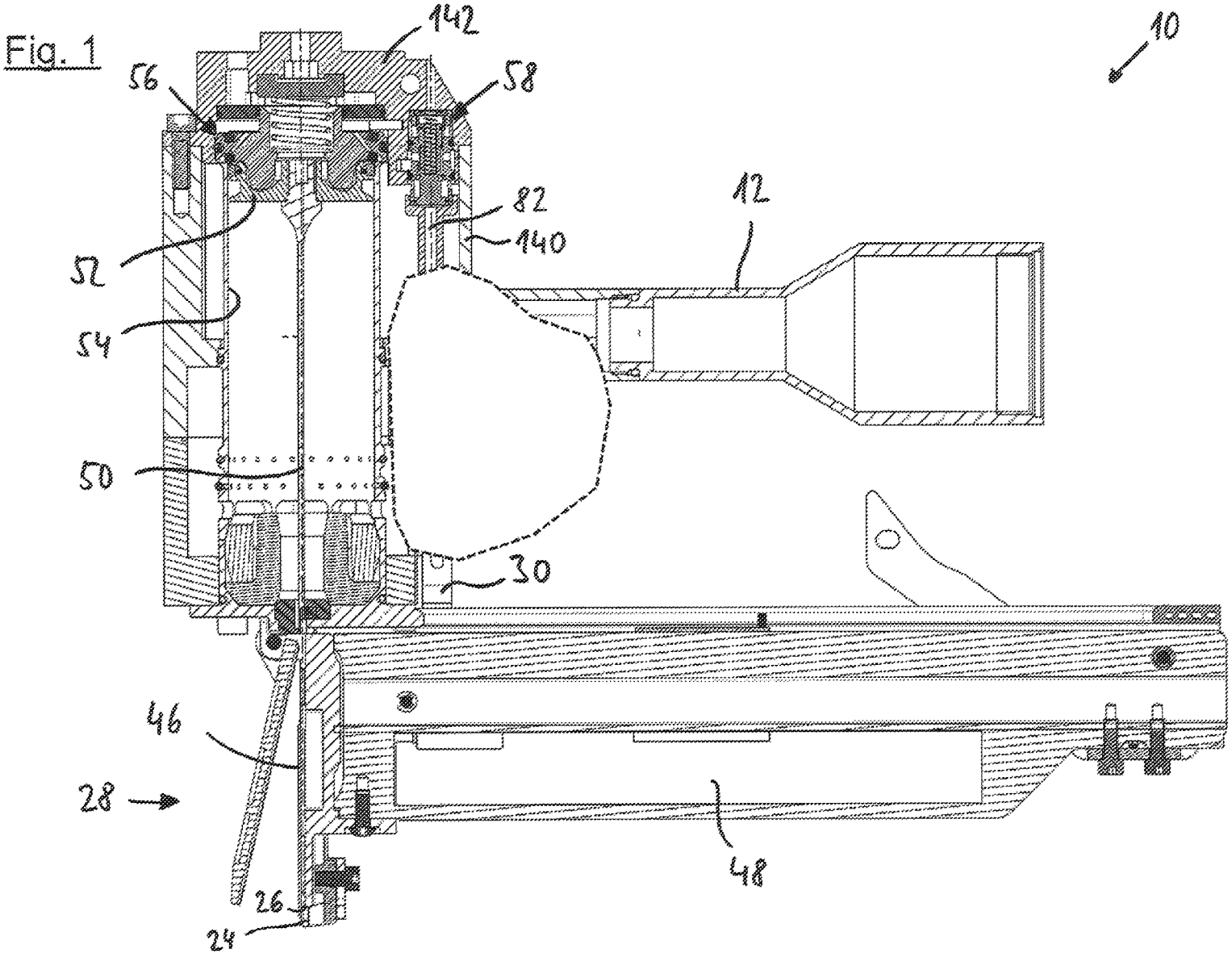
FIG. 1 illustrates a partial cross-sectional view of an embodiment of a compressed air nailer.

Initially, a few important elements of the compressed air nailer 10 will be described, some summarily, with reference to FIG. 1. The compressed air nailer 10 has a handle 12 that is attached to a lower housing part 140 which is closed at the top by a housing cap 142.

The compressed air nailer 10 has a placing sensor 24 that projects downward a few millimeters beyond the mouth 26 of an outlet tool 28. If the compressed air nailer 10 is placed onto a workpiece, the placing sensor 24 is displaced upward against the force of a spring (not shown) until it abuts the mouth 26 flush, or projects just slightly above the mouth 26. The placing sensor 24 is mechanically coupled to a force transmission element 30 which also moves upward when the placing sensor 24 moves.

The outlet tool 28 has a receiver 46, in each case a fastening means being supplied thereto from a magazine 48. From this position inside the receiver 46, the fastening means—for example a nail, a tack or a staple—is driven in by a driving tappet 50 which is connected to a working piston 52 of the compressed air nailer 10. To this end, the working piston 52 is guided in a working cylinder 54. Above the working cylinder 54 and sealingly closing this working cylinder, a main valve 56 is arranged, to the right thereof being a pilot valve 58 which controls the main valve 56. Details of these elements as well as the associated function of the device will be explained with reference to the enlargement of a section in FIG. 2.

Figure 2:
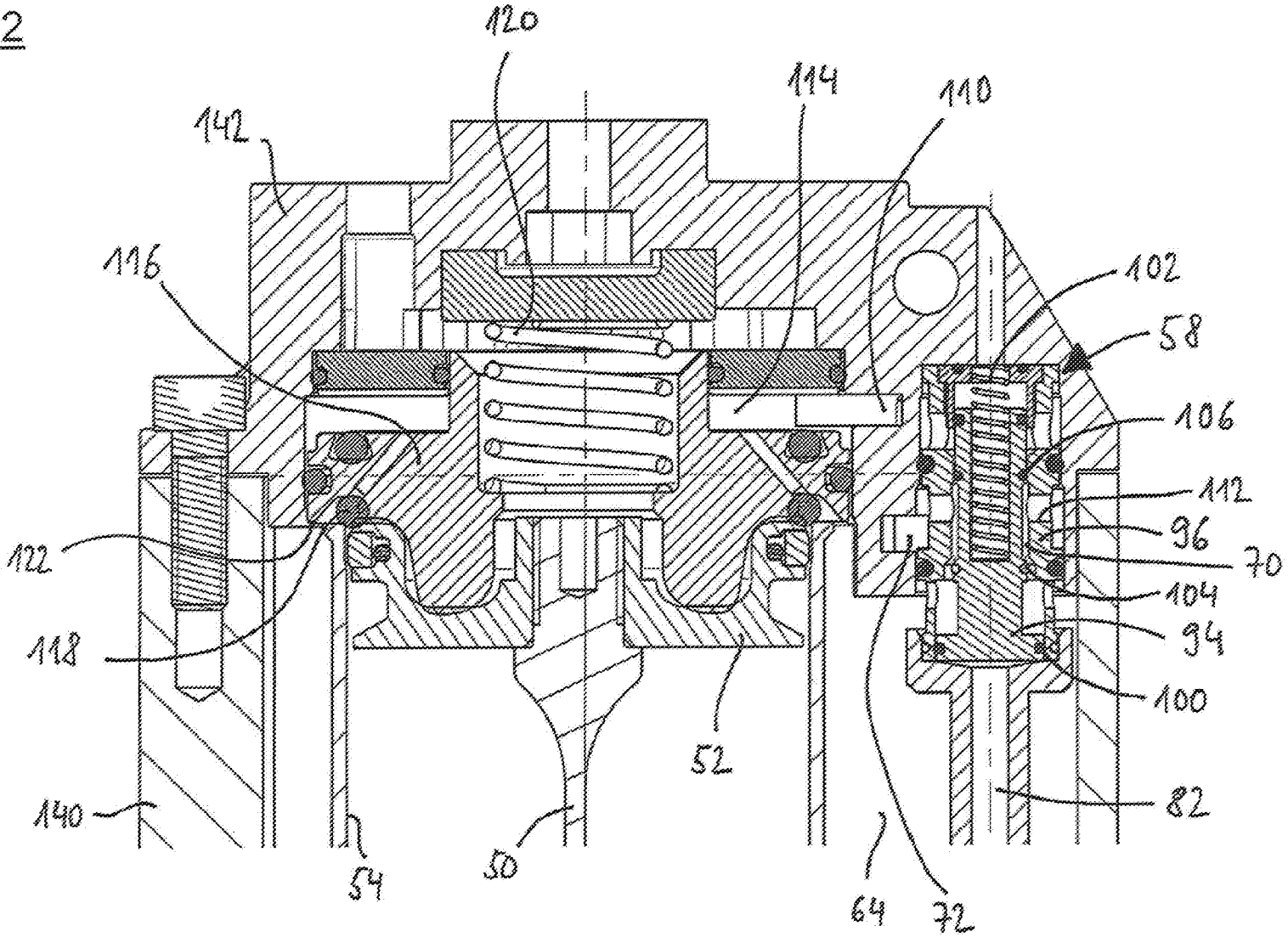
FIG. 2 illustrates an enlarged view of a section of the embodiment of FIG. 1 showing a main valve and a pilot valve.

The pilot valve 58 is best discernible in FIG. 2. It has a control piston 94 which is guided in a guide sleeve 96. The lower end of the control piston 94 is sealed by a lower O-ring 100 relative to the guide sleeve 96. In the initial state of the compressed air nailer 10, a first control line 82 which is connected to a working volume of the pilot valve 58 is deaerated, and the control piston 94 is located in the shown lower position. It is retained in this position by the force of a spring 102.

The control piston 94 has, in addition to the lower O-ring 100, a central O-ring 104 and an upper O-ring 106. In the shown lower position of the control piston 94, the upper O-ring 106 seals the control piston 94 against the guide sleeve 96 and closes a connection to a deaeration opening (not shown) connected to external air. The central O-ring 104 is not sealed, so that a main control line 110 is connected to the housing interior 64 via a radial bore 112 in the guide sleeve 96 and the annular gap 70 between the control piston 94 and guide sleeve 96 running past the central O-ring 104. The main control line 110 is connected via a connection, which is invisible in the depicted sectional plane, to the space 72 that terminates in the radial bore 112. The housing interior 64 in the initial state of the compressed air nailer 10 is aerated, i.e. connected to a compressed air connection, not shown, and at operating pressure.

The main control line 110 is connected to a space 114 above a main valve actuating member 116 of the main valve 56 such that the main valve actuating member 116 is subjected to a downward force which seals the upper edge of the working cylinder 54 by means of an O-ring 118 against the housing interior 64. Additionally, the main valve actuating member 116 is acted upon by a spring 120 with a force in the direction of the position shown, closing the working cylinder 54.

A driving process is triggered by aerating the first control line 82 in that the control piston 94 is displaced upward so that the central O-ring 104 creates a seal and the upper O-ring 106 releases the seal. This blocks the connection of the main control line 110 to the housing interior 64, and a connection between the main control line 110 and a deaeration opening (not shown) is established. The space 114 above the main valve actuating member 116 is deaerated via the deaeration opening, and the main valve actuating member 116 is displaced upwardly counter to the force of the spring 120 by the pressure which is present on its lower outer annular surface 122 and which prevails in the housing interior 64. As a result, compressed air flows out of the housing interior 64 into the working cylinder 54 above the working piston 52 and drives the working piston 52 downwardly. With this downward movement, the driving tappet 50 connected to the working piston 52 drives in a fastening means. Below the pilot valve 58, there is a triggering apparatus which is covered in FIG. 1 by a surface surrounded by a dashed line. Details of the triggering apparatus will be explained in greater detail with reference to FIGS. 3 to 6.

It can be seen in these figures that the trigger 14 is rotatably mounted about a pivot axis 16 in an easy-to-grip position on the housing of the compressed air nailer 10. The upper, rear end of the trigger 14 has a switching surface 18 which displaces a switching pin 20 of a second control valve 22 upward upon an actuation of the trigger 14. This control of the second control valve 22 occurs upon each actuation of the trigger 14 independent of the position of the placing sensor 24.

The force transmission element 30 of the placing sensor 24 is movably guided on the housing of the compressed air nailer 10 and has a slot 32 through which a guide pin 98 is guided. Upon an actuation of the placing sensor 24, the force transmission element 30 is displaced upward from the starting position drawn in FIG. 3, and in so doing entrains the free end of a rocker 36, the fixed end of which is pivotably articulated about a pivot axis 38 in the interior of the trigger 14 and close to its free end. The rocker 36 is then arranged approximately parallel to a longitudinal direction of the trigger 14, and its upper side functions as a switching surface 40 which, given the joint actuation of the placing sensor 24 and the trigger 14, displaces a switching pin 42 of a first control valve 44 upward and thus controls the first control valve 44.

Figure 3:
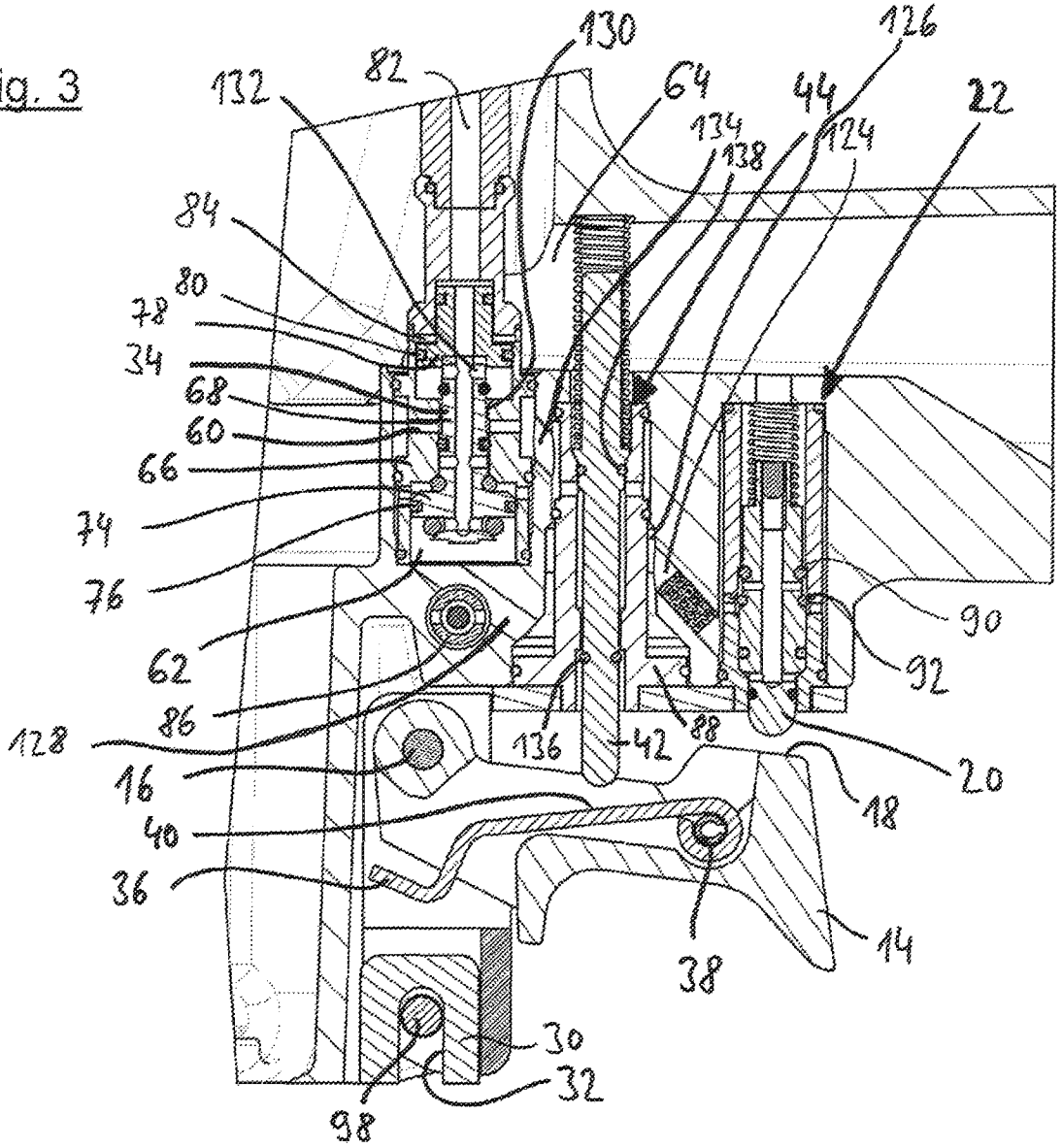
FIG. 3 illustrates an enlarged view of the embodiment of FIG. 1 in an operating state.

At the top left in FIG. 3, the first control line 82 is discernible which runs to the pilot valve 58. A safety actuator 34 is shown below the first control line 82 which performs a valve function. The safety actuator 34 can be displaced between an open position and a closed position. It is drawn in its open position in FIG. 3.

The safety actuator 34 is guided in a sleeve 66 and has a middle section 68. In the region of the middle section 68, the sleeve 66 has a radial bore 60. At the lower end of the middle section 68, the safety actuator 34 has a lower piston section 74 which is sealed by an O-ring 76 against a cylindrical space. The part of this cylindrical space arranged below the piston section 74 forms a safety control chamber 62. The pressure prevailing in the safety control chamber 62 exerts an actuating force on the lower piston section 74 and thereby on the safety actuator 34 and attempts to displace it into its open position, or respectively to hold it therein. The safety control chamber 62 is connected to external air via a throttle 86.

At the upper end of the middle section 68, the safety actuator 34 has an upper piston section 78 which is also guided in a cylindrical chamber and is sealed against the cylindrical space by an O-ring 80. The upper piston section 78 is made as a separate part and adjoins the lower piston section 74. The part of the cylindrical space arranged above the upper piston section 78 forms a control space 84 which is continuously connected to a housing interior 64. Once the compressed air nailer 10 is connected to a compressed air supply, the housing interior 64 is aerated. The operating pressure prevailing in the control space 84 thereby exerts a counterforce on the upper piston section 78 and hence on the safety actuator 34. This counterforce is directed in the opposite direction of the actuating force and attempts to displace the safety actuator 34 into its locked position.

When the trigger 14 is in the non-actuated state shown in FIG. 3, the second control valve 22 is not actuated. The two O-rings 90, 92 of the second control valve 22 do not provide a seal so that a line 124 running to the first control valve 44 is connected to the housing interior 64 via the second control valve 22. Independent of the position of the first control valve 44, the air flows from the line 124 through an annular gap 126 that surrounds a sleeve 88 of the second control valve 44 and a bore 128 into the safety control chamber 62. Because the amount of air simultaneously escaping through the throttle 86 is negligible in comparison to this inflow, substantially the operating pressure always prevails in the initial state in the safety control chamber 62.

In this case, the actuating force exerted on the safety actuator 34 by the pressure in the safety control chamber 62 is greater than the counterforce exerted by the operating pressure in the control space 84. The safety actuator 34 therefore remains in its open position. In this open position, the first control line 82 is connected to a line 134 running to the first control valve 44 via a radial bore 132 in the middle section 68 of the safety actuator 34 and an annular gap 130, as well as the radial bore 68 in the sleeve 66. Since an O-ring 136 of the first control valve 44 does not provide a seal when the first control valve 44 is in the unactuated position, the line 134 is connected via the first control valve 44 to external air. At the same time, the O-ring 138 of the first control valve 44 provides a seal and separates the line 134 from the housing interior 64.

Figure 4:
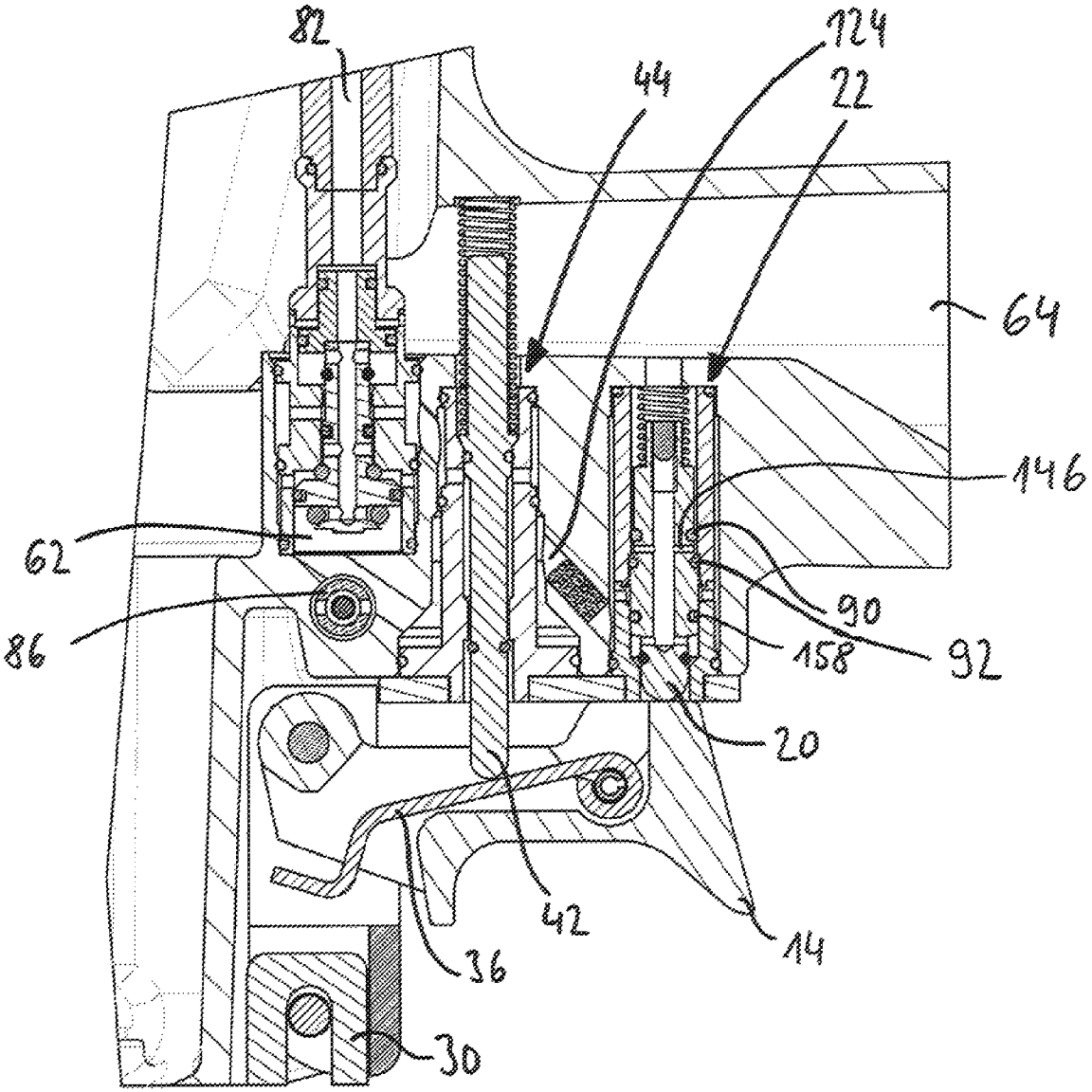
FIG. 4 illustrates an enlarged view of the embodiment of FIG. 1 in another operating state.

In FIG. 4, the trigger 14 has been actuated, and the second control valve 22 along with it. It can be seen that the control pin 20 of the second control valve 22 has been displaced upward. The O-ring 90 now provides a seal and separates the housing interior 64 from the line 124. This ends the air supply to the safety control chamber 62 so that the pressure in the safety control chamber 62 slowly decreases by the air escaping through the throttle 86. The O-ring 92 also provides a seal. It prevents a leakage flow to the line 124 when the O-ring 90 is leaky. Instead, such a leakage flow is discharged outward via the cross bore 146 located between the two O-rings 90, 92 in the valve pin 20. Another O-ring 158 of the second control valve 22 still provides a seal, so that the line 124 is separated from the external air when the second control valve 22 is actuated.

Figure 5:
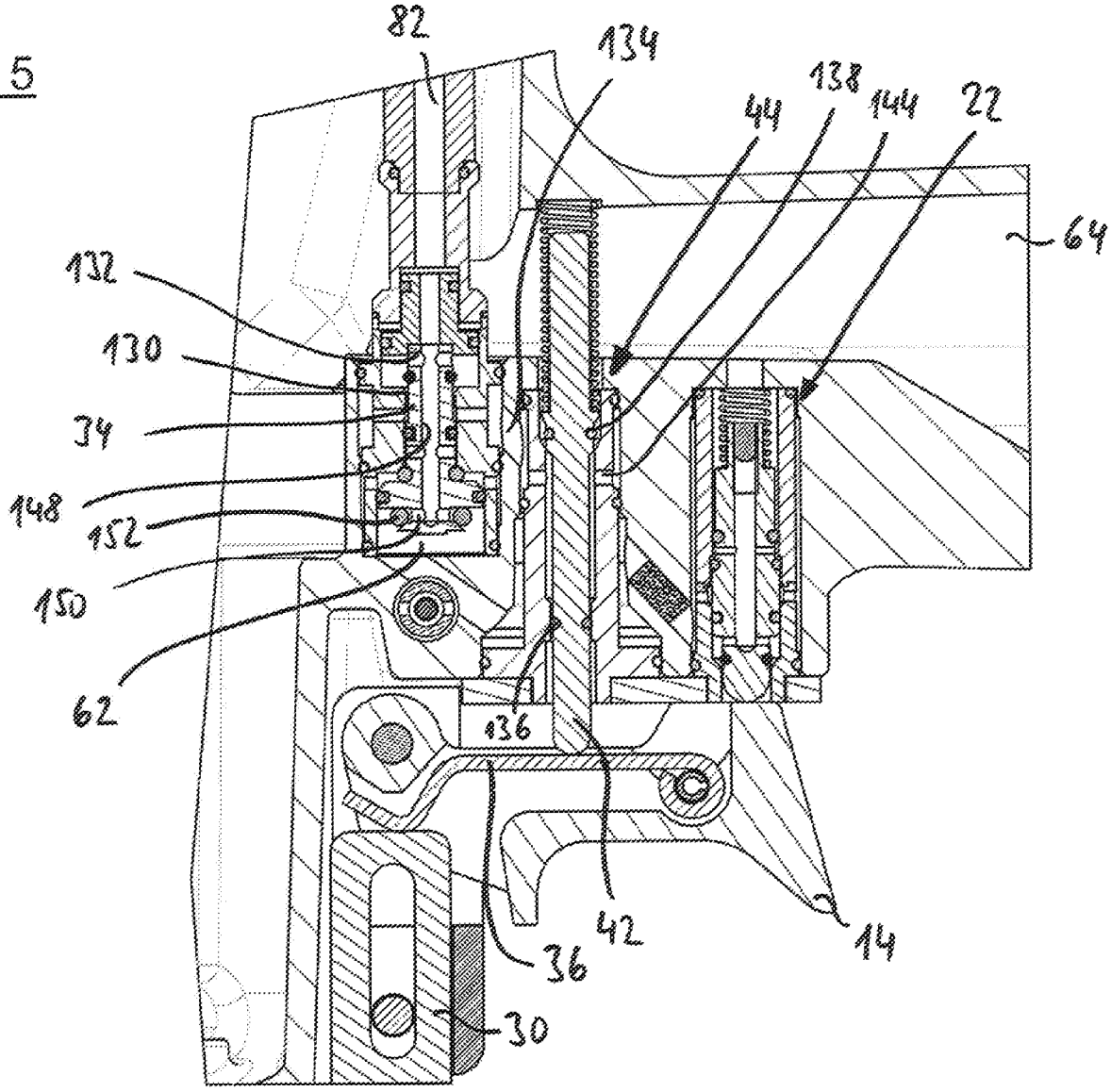
FIG. 5 illustrates an enlarged view of the embodiment of FIG. 1 in another operating state.

If, starting from the situation in FIG. 4, the placing sensor 24 is actuated within a short time span, the force transmission element 30 assumes the position shown in FIG. 5 and entrains the rocker 36 upward so that the switching pin 42 of the first control valve 44 is displaced upward and the first control valve 44 is actuated. The O-ring 136 then moves into a seal, whereas the O-ring 138 releases the seal. The housing interior 64 is thus connected via the radial bore 144 to the line 134, which effectuates an aeration of the first control line 82 and hence a triggering of a driving process.

Another effect of aerating the line 134 is that the safety control chamber 62 is aerated via the annular gap 130, the radial bore 132 and an axial bore 148 that extends in the middle through the safety actuator 34 over a majority of the length, as well as through another radial bore 150 in the safety actuator 34 and the O-ring 152 acting as a non-return valve. The pressure in the safety control chamber 62 is also refreshed so that the period in which an additional contact triggering is possible starts to run again.

Figure 6:
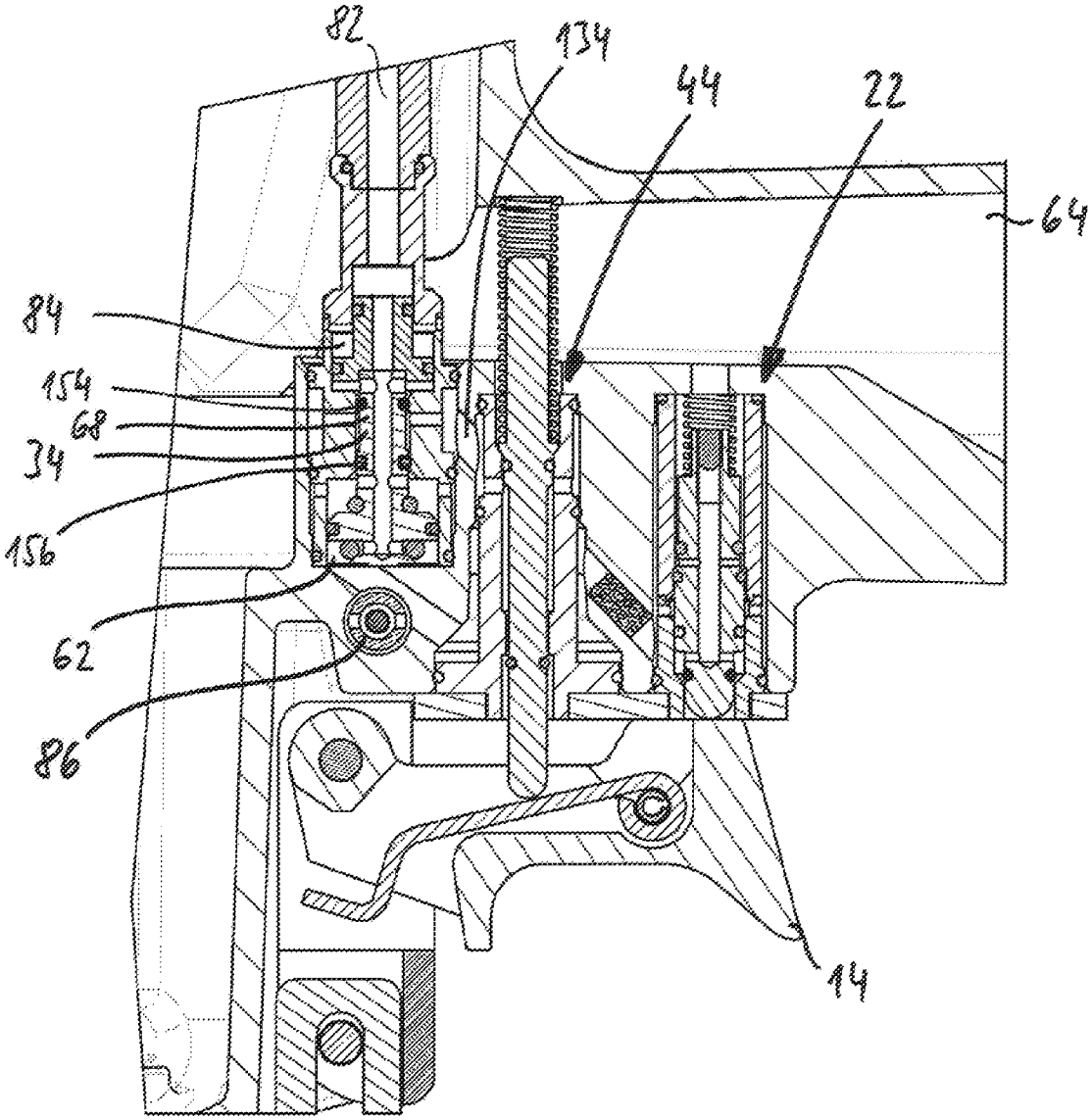
FIG. 6 illustrates an enlarged view of the embodiment of FIG. 1 in yet another operating state.

If there is no actuation of the placing sensor 24 within this period, the pressure in the safety control chamber 62 finally decreases enough for the counterforce to overcome the actuating force, and the safety actuator 34 assumes its locked position. This is shown in FIG. 6. If the placing sensor 24 and the first control valve 44 along with it are then re-actuated, the line 134 is again aerated. Due to the two O-rings 154, 156 providing a seal on the middle section 68 of the safety actuator 34, this however remains unsuccessful. In the locked position, the safety actuator 34 blocks the line 134 both from the first control line 82 as well as from the safety control chamber 62. Another driving process can therefore only be triggered again when the trigger 14 is released and the pressure in the safety control chamber 62 is restored by the second control valve 22 so that the safety actuator is displaced into its open position.

List of Reference Numbers

10 Compressed air nailer
12 Handle
14 Trigger
16 Pivot axis
18 Switching surface
20 Switching pin
22 Second control valve
24 Placing sensor
26 Mouth
28 Outlet tool
30 Force transmission element
32 Slot
34 Safety actuator
36 Rocker
38 Pivot axis
40 Switching surface
42 Switching pin
44 First control valve
46 Receiver
48 Magazine
50 Driving tappet
52 Working piston
54 Working cylinder
56 Main valve
58 Pilot valve
60 Radial bore
62 Safety control chamber
64 Housing interior
66 Sleeve
68 Middle section
70 Annular gap
72 Space
74 Lower piston section
76 O-ring
78 Upper piston section
80 O-ring
82 First control line
84 Control space
86 Throttle
88 Sleeve
90 O-ring
92 O-ring
94 Control piston
96 Guide sleeve
98 Guide pin
100 Lower O-ring
102 Spring
104 Central O-ring
106 Upper O-ring
110 Main control line
112 Radial bore
114 Space
116 Main valve actuating member
118 O-ring
120 Spring
122 Annular surface
124 Line
126 Annular gap
128 Bore
130 Annular gap
132 Radial bore
134 Line
136 O-ring
138 O-ring
140 O-ring
142 Housing cap
144 Radial bore
146 Cross bore
148 Axial bore
150 Radial bore
152 O-ring
154 O-ring
156 O-ring
158 O-ring

The invention claimed is:

1. A compressed air nailer having an operating pressure and comprising:

a driving tappet connected to a compressed air supply and configured to drive in a fastener;

a triggering apparatus configured to trigger a driving process;

a working piston coupled to the driving tappet, wherein compressed air is supplied when the driving process is triggered;

a safety actuator configured to be moved between a locked position and an open position, wherein when in the locked position, the safety actuator is configured to inhibit the triggering of the driving process when an actuation of the triggering apparatus occurs;

a throttle;

a safety control chamber configured to be aerated and deaerated by the throttle, wherein a pressure in the safety control chamber exerts an actuating force on the safety actuator; and a counterforce generator configured to generate a counterforce that acts on the safety actuator and is directed in an opposite direction from the actuating force, wherein the counterforce is linearly dependent on the operating pressure, and wherein the counterforce is configured to move the safety actuator into the locked position.

2. The compressed air nailer according to claim 1, wherein the counterforce is from 10% to 90% of an actuating force when the operating pressure prevails in the safety control chamber.

3. The compressed air nailer according to claim 1, wherein the counterforce generator comprises a control space, and wherein a pressure in the control space acts on the safety actuator.

4. The compressed air nailer according to claim 3 wherein the pressure in the safety control chamber acts on a first effective surface of the safety actuator and the pressure in the control space acts on a second effective surface of the safety actuator, and wherein the second effective surface is smaller than the first effective surface.

5. The compressed air nailer according to claim 4, wherein the second effective surface is from 10% to 90% of a size of the first effective surface.

6. The compressed air nailer according to claim 3, wherein the operating pressure prevails in the control space when the compressed air nailer is connected to the compressed air supply.

7. The compressed air nailer according to claim 1, further comprising a spring configured to exert an additional force on the safety actuator.

8. The compressed air nailer according to claim 1, wherein the triggering apparatus comprises:

a trigger; and a placing sensor, wherein jointly actuating the trigger and the placing sensor acts to control a first control valve and trigger the driving process, and wherein the safety actuator is configured to release a mechanical engagement between the triggering apparatus and the first control valve when in the locked position.

9. The compressed air nailer according to claim 1, further comprising a first control line, wherein aeration or deaeration of the first control line triggers the driving process, and wherein the safety actuator is configured to block a connecting line between the first control line and the triggering apparatus when the safety actuator is in a lock position.

10. The compressed air nailer according to claim 1, wherein the triggering apparatus comprises:

a trigger; and a placing sensor, wherein jointly actuating the trigger and the placing sensor acts to control a first control valve and trigger the driving process if the pressure in the safety control chamber is above a given pressure threshold.

11. The compressed air nailer according to claim 10, further comprising a second control valve configured to be controlled independent of an actuation of the placing sensor when the trigger is actuated, wherein the safety control chamber is continuously deaerated by the throttle independent of the position of the second control valve, and wherein the safety control chamber is separated from a housing interior, and wherein the housing interior is under pressure when the second control valve is controlled.

12. The compressed air nailer according to claim 11, wherein the throttle comprises an opening cross-section dimensioned such that the actuating force falls below the counterforce after an expiration of a period within a range of from 1 second to 10 seconds after the second control valve is controlled.

13. The compressed air nailer according to claim 12, further comprising a non-return valve configured to aerate the safety control chamber when the driving process is triggered.

* * * * *